US009525232B1

(12) United States Patent
Insalaco

(10) Patent No.: US 9,525,232 B1
(45) **Date of Patent: *Dec. 20, 2016**

(54) FUNCTIONAL INDOOR ELECTRICAL WALL OUTLET COVER

(71) Applicant: Socket Solutions, LLC, Houston, TX (US)

(72) Inventor: Michael George Insalaco, Houston, TX (US)

(73) Assignee: Socket Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/224,496

(22) Filed: Jul. 29, 2016

Related U.S. Application Data

(63) Continuation-in-part of application No. 15/099,559, filed on Apr. 14, 2016.

(51) Int. Cl.

| | |
|---|---|
| ***H01R 13/60*** | (2006.01) |
| ***H01R 13/447*** | (2006.01) |
| ***H01R 24/70*** | (2011.01) |
| ***H01R 25/00*** | (2006.01) |
| *H01R 103/00* | (2006.01) |

(52) U.S. Cl.
CPC ..... *H01R 13/447* (2013.01); *H01R 24/70* (2013.01); *H01R 25/003* (2013.01); *H01R 2103/00* (2013.01)

(58) Field of Classification Search
CPC ..... H02G 3/14; H01R 13/447; H01R 13/652; H01R 13/443; H01R 25/006; H01R 23/025; H01R 31/02
USPC ..... 174/66, 67; 220/241, 242; 439/106, 107, 439/142, 147–149, 535, 536, 652
See application file for complete search history.

(56) References Cited

U.S. PATENT DOCUMENTS

| | | | | |
|---|---|---|---|---|
| 3,714,616 A * | 1/1973 | Sample | H01R 31/02 | 174/67 |
| 5,004,435 A * | 4/1991 | Jammet | H01R 25/006 | 439/652 |
| 5,094,630 A * | 3/1992 | Jammet | H01R 31/02 | 439/652 |
| 5,375,728 A * | 12/1994 | West | H02G 3/14 | 174/488 |
| 5,723,816 A * | 3/1998 | Neece | H02G 3/14 | 174/66 |
| 6,703,562 B1 * | 3/2004 | Pacheco | H02G 3/14 | 174/66 |

(Continued)

*Primary Examiner* — Thanh Tam Le
(74) *Attorney, Agent, or Firm* — Karen B. Tripp

(57) ABSTRACT

An indoor electrical wall outlet cover permitting functional use of an electrical wall outlet while fully concealing the plug contact openings of the outlet. The cover has a functional electrical plug that inserts into the wall outlet and is connected to an extended electrical cord having at its distal end one or more functional electrical receptacles for indirect use of the wall outlet. In one embodiment, the cover is essentially featureless in outward appearance, and when positioned over the wall outlet, the cover fully hides the wall outlet from view, including the perimeter dimension of the wall outlet. The functional electrical plug has electrical connection pins that are bent at an angle enabling the cover to function without extending any significant degree outward of the wall outlet, so that furniture may be positioned effectively flush against the wall in front of the covered wall outlet.

20 Claims, 3 Drawing Sheets

(56) References Cited

U.S. PATENT DOCUMENTS

| | | | | |
|---|---|---|---|---|
| 6,897,381 | B2 * | 5/2005 | He | A01M 1/2072 174/66 |
| 6,977,342 | B1 * | 12/2005 | Maltby | H02G 3/14 174/66 |
| 8,158,885 | B2 * | 4/2012 | Eastin | H02G 3/14 174/66 |
| 8,242,364 | B1 * | 8/2012 | Shotey | H02G 3/14 174/57 |
| 8,668,347 | B2 * | 3/2014 | Ebeling | H01R 13/5213 174/66 |
| 8,834,210 | B2 * | 9/2014 | Brausen | H01R 13/7135 439/718 |

* cited by examiner

FUNCTIONAL INDOOR ELECTRICAL WALL OUTLET COVER

RELATED PATENT APPLICATION

This patent application claims priority from and is a continuation in part of U.S. patent application Ser. No. 15/099,559, filed Apr. 14, 2016, pending, the contents of which are incorporated herein by reference.

BACKGROUND OF THE INVENTION

1. Field of the Invention

The present invention relates to electrical connector devices. More particularly, the invention relates to indoor electrical outlets and indoor electrical outlet covers.

2. Description of Relevant Art

Electrical service in buildings, particularly in homes, offices, and schools, is typically provided at least in part through electrical wall outlets. Devices needing electrical current for operation or use have electrical cords ending in electrical plugs for connection to an electrical wall outlet. Once the plug is inserted into the wall outlet, electrical current can flow (or does flow if the wall outlet has electrical current flowing into it) to the cord for activating the device needing current.

Most typically, when a plug with a cord is connected to an electrical wall outlet, the plug and cord extend several inches from the wall outlet before the cord curves to a parallel posture with respect to the wall. As a consequence, furniture or other items positioned adjacent to the wall must be positioned sufficiently away from the wall outlet to accommodate the plug and cord connection to the wall outlet and also to accommodate someone's hand and often times arm in reaching behind the furniture to insert the plug into the wall outlet. Such positioning wastes space in the room and is generally unattractive.

Moreover, typically and commonly used electrical wall outlets are themselves generally unattractive and are known to pose a potential safety hazard for infants and children. Blank cover plates and individual non-conductive plugs are commonly used to prevent children from inserting objects into wall outlet receptacles and getting shocked and injured thereby, but such plates and plugs then prevent use of the outlets.

There is presently a need in the art for electrical wall outlets and electrical wall outlet covers that overcome the shortcomings presented above.

SUMMARY OF THE INVENTION

The present invention provides an indoor electrical wall outlet cover that solves the problems associated with indoor outlet covers. The present invention provides an indoor electrical wall outlet cover that is thin enough to avoid adding bulk to the outlet and thus enables furniture to effectively be positioned against the wall or at least as close as the baseboard on the wall, that also effectively covers the outlet so as to act as a safety device for a child that may seek to touch or access the outlet receptacles, and that still allows ready access to the electrical connection that the outlet affords. Moreover, the outlet cover is aesthetically pleasing—it is unobtrusive and calls less attention to itself than does the outlet without the cover of the invention. This is because the outlet cover, at least in one embodiment, is essentially or substantially blank, hides the receptacles of the outlet completely, and results in only one cord extending from the outlet and that extension is in a manner where the cord lies against the wall or along the wall or less than about an inch from the wall, at least when proximate the outlet.

The present invention effects these advantages by providing a thin cover, preferably smooth on the outside, that just extends fully over the surface of an electrical outlet having at least two receptacles, without protruding significantly therefrom and that has an electrical connection component on the backside that plugs into a receptacle of the outlet for making electrical contact. The cover has at least one hole extending therethrough for receiving a screw positioned to be corresponding to or aligning with an aperture of the outlet having internal threads to receive the screw, and such screw or screws, together with the electrical connection component of the invention, attach the cover of the invention to the outlet. The electrical connection component of the cover of the invention has an electrical cord attached thereto that extends downward from the electrical connection component out of the cover and falls generally flush with the wall to the floor, where the cord lies against the wall or along the wall or less than about an inch from the wall, at least when proximate the outlet, and then lies along the floor or other desired surface, ending in one or more electrical receptacles. The electrical connection component in one embodiment has electrical pins bent at an approximately ninety degree angle so that the connection of that component in the receptacle does not add bulk or cause the cover to extend significantly beyond the outer surface of the electrical wall outlet.

BRIEF DESCRIPTION OF THE DRAWINGS

The present invention will be better understood by referring to the following detailed description of preferred embodiments and the drawings referenced therein, in which.

DETAILED DESCRIPTION OF PREFERRED EMBODIMENTS

Figure 2:
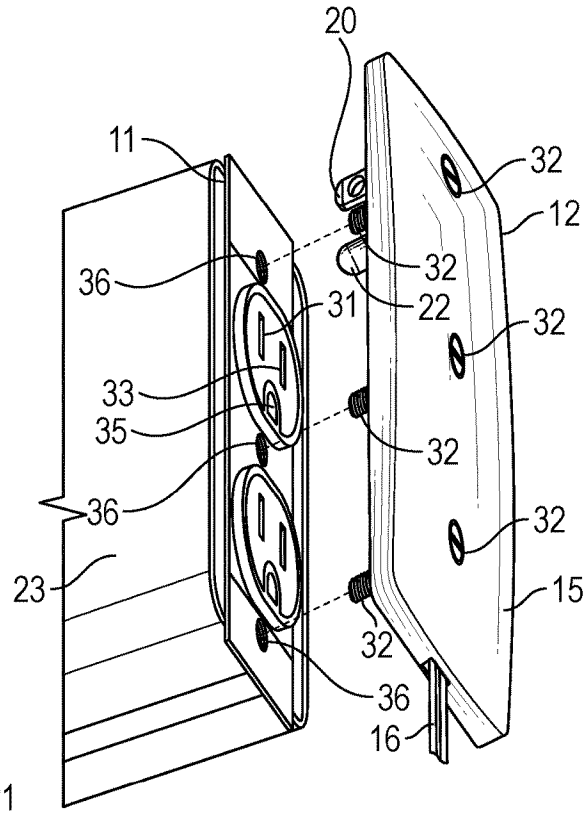
FIG. 2 is an enlarged front side perspective view of the embodiment of the apparatus of the invention of FIG. 1, just before it is attached to a typical electrical outlet on a wall (for illustration and not drawn to scale).

The present invention provides an apparatus for the indoor use of electricity through an indoor, thin, blank electrical wall outlet cover in a manner that fully conceals the underlying electrical wall outlet and one or more electrical plugs directly connected to that outlet and an electrical cord extending from said electrical plug(s), past, through, or out of the cover, preferably at the base of the cover, and ending a desired distance away with at least one receptacle at the electrical cord's distal end. This apparatus of the invention is particularly advantageous as a safety device that permits functional use of a standard or typical indoor electrical wall outlet while fully concealing the wall outlet and particularly concealing and shielding the openings or receptacles in the outlet from access by children. The apparatus of the invention obtains such safety advantage while being so thin as to avoid adding any significant bulk to the wall outlet, thereby enabling a user to position furniture in front of or adjacent to the outlet and essentially flush with, i.e., less than about an inch away from, the wall on which the outlet is located, or at least as close to the wall as any baseboard on the wall permits, and thereby providing another advantage of the invention.

The present invention eliminates the traditional manner of connecting a visible electrical plug to a visible indoor electrical wall outlet in order to consume electricity through such electrical wall outlet. Interior electrical wall outlets are points in an interior space of a building such as a home where electrical current can be run to power electrical devices such as appliances and electronics. The most common such outlets are 15-amp (and sometimes 20-amp) duplex receptacles, which are designed to accept standard plugs for most small appliances, electronics such as televisions and home theater systems as well as cellular phones and portable computing devices such as laptops and tablet computers, and lamps. The invention has utility with any such interior electrical wall outlets, and the term "typical (or standard) indoor electrical wall outlet" herein is understood to refer to an outlet that is compatible with a United States of America three pin plug type (known as Type B plug type as categorized by the U.S. Department of Commerce International Trade Administration) as well as similar outlets that have more receptacles. United States type electrical plugs and electrical wall outlets are used herein for illustration, but the invention also has similar or like utility with interior electrical wall outlets commonly used in South America, Europe, Asia and Australia, and the term "typical non-U.S. indoor electrical wall outlet" herein is understood to refer to an outlet that is compatible with one of the approximately thirteen electrical plug types currently in use in South America, Europe, Asia and Australia (known as any plug type categorized by the U.S. Department of Commerce International Trade Administration other than Type A plug type and Type B plug type).

Figure 1:
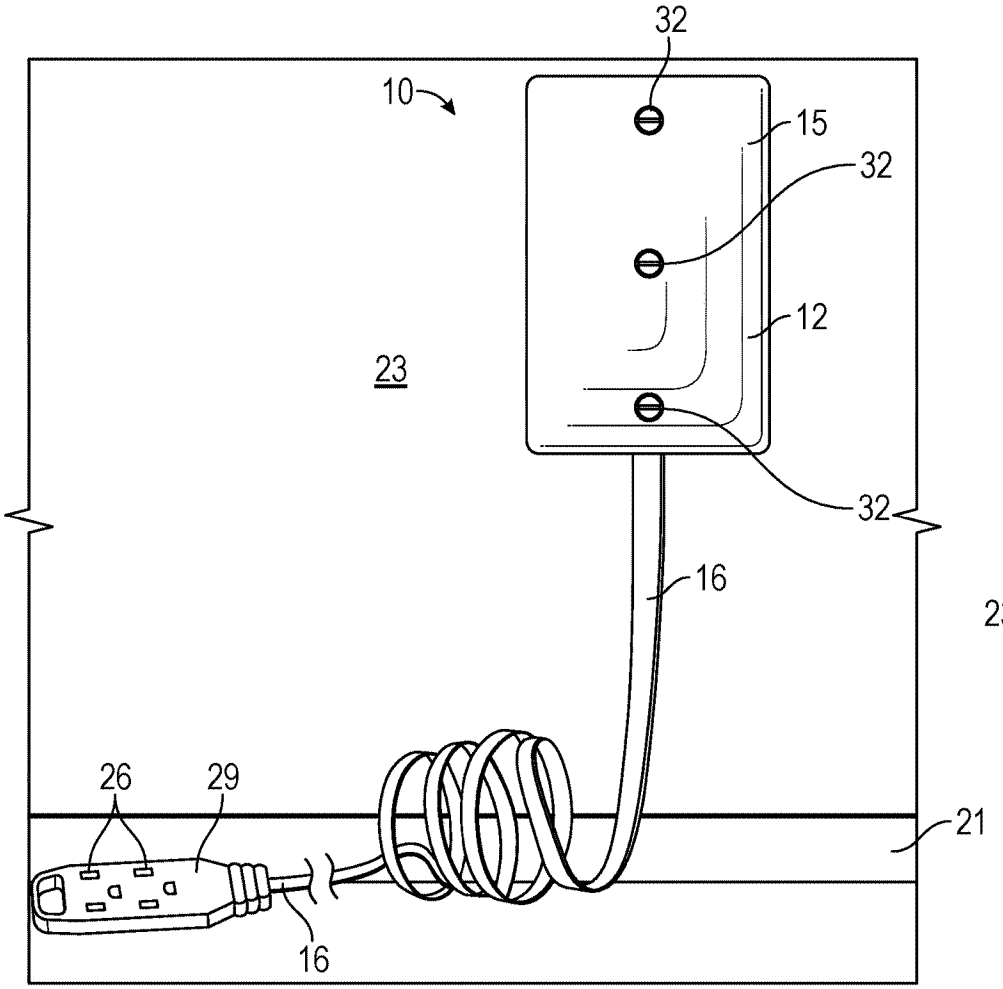
FIG. 1 is a front perspective view (for illustration and not drawn to scale) of one embodiment of the apparatus of the invention, as shown in place on an electrical outlet as it might typically be used.
Figure 4:
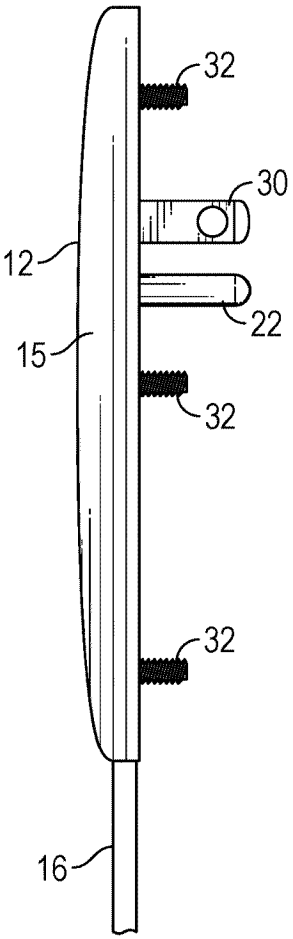
FIG. 4 is a side view of the embodiment of the apparatus of the invention of FIG. 1.

Referring to FIG. 1, one embodiment of the apparatus 10 of the invention is shown attached to an indoor electrical wall outlet 11 typical in the United States of America (not shown in FIG. 1 but shown in FIG. 2) on an interior wall 23. FIG. 2, showing the cover 15 of apparatus 10 just before attachment to the electrical wall outlet 11, and FIG. 4, showing the side of cover 15, indicate the thin, low profile of cover 15, particularly comprising frontplate component 12 mounted on backplate component 14.

In another embodiment of the apparatus of the invention, the frontplate component is extruded or molded together, or as one piece with the backplate component of the cover, and around the electrical flat pins 18 and 28, the round ground pin 19, and electrical cord 16, such that the cover is effectively or essentially one piece with the electrical connection component and the backplate protruding therefrom on the backside of the apparatus of the invention.

FIGS. 1 and 2 are drawn to illustrate features of the invention and are not drawn to scale. That is, cover 15 is drawn larger with respect to the remainder of the apparatus 10 and with respect to the wall outlet 11 than is actually contemplated to in fact occur with the embodiments of the invention as will be more fully explained below.

As used herein, the term "frontplate" with respect to the apparatus of the invention and particularly cover 15 means the faceplate or faceplate component of cover 15, and not the common faceplate of the wall outlet. The apparatus of the invention 10 is used to hide the wall outlet 11. The apparatus of the invention is a replacement or substitute of the common faceplate of the wall outlet 11. To avoid any confusion between the common faceplate of a wall outlet and the faceplate of the cover of the apparatus of the invention, the faceplate component of the cover 15 of the apparatus 10 of the invention will be called herein the "frontplate." The frontplate and backplate components of the invention are made of material that satisfies NEMA Standards or standards for UL safety certification. Such materials are characterized by resistance to chemicals, heat and impact, and typical applications include use in appliance housings and electronic and electrical assemblies. These materials include various plastics, including acrylonitrile butadiene styrene or ABS and polyvinyl chloride or PVC.

Figure 3:
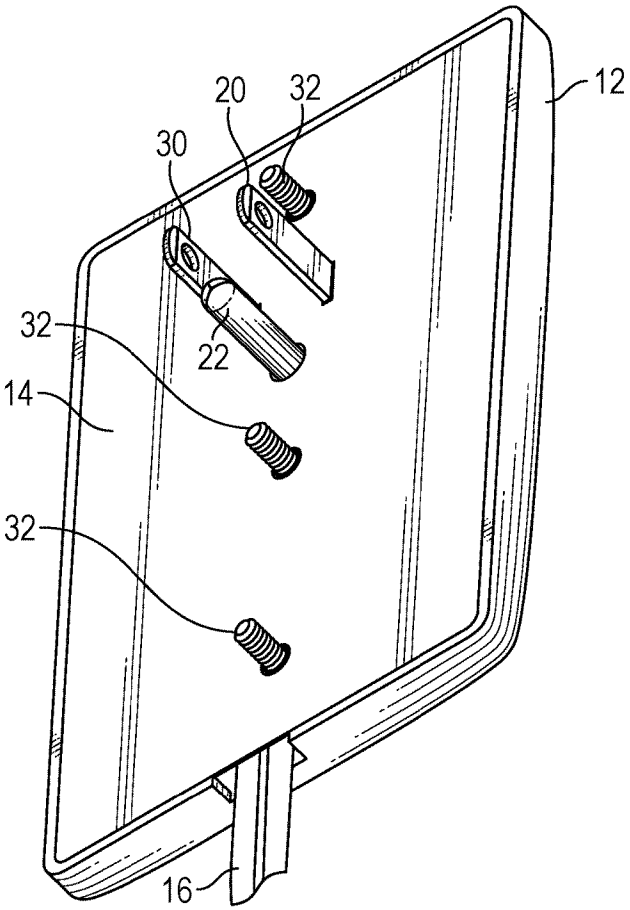
FIG. 3 is a back perspective view of the embodiment of the apparatus of the invention of FIG. 1.

In one embodiment, the maximum distance between the backplate component 14 and the frontplate component 12 is approximately the height or thickness of the electrical cord 16 connected to or attached to the backplate component 14, and this distance is only in the main body or central portion of the cover 15, as the outer or perimeter edges of the components 12 and 14 are proximate one another and touch or essentially touch, with the perimeter edge of backplate component 14 fitting inside the outer edge of frontplate component 12, as shown in FIG. 3. The frontplate component 12 is sized to align and position over and preferably curve slightly around or up to the perimeter edge of the backplate component 14 for a tight fit—preferably tight enough to require no adhesive or screws to hold the components 12 and 14 together.

Figure 5:
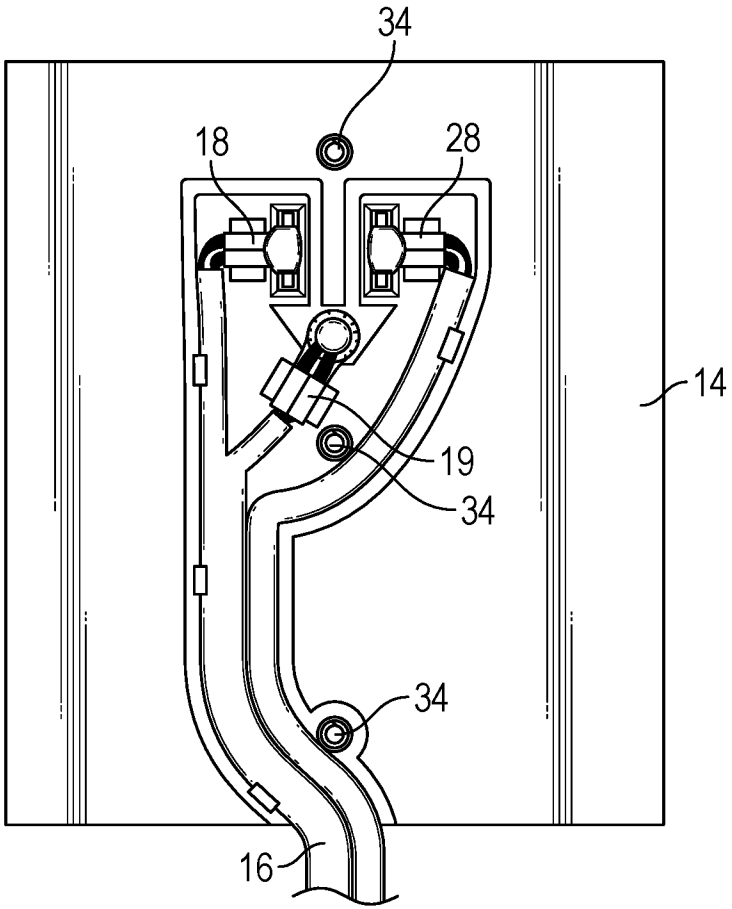
FIG. 5 is a view of the inside of the back plate of the embodiment of the apparatus of the invention of FIG. 1 showing the electrical connection component having electrical pins bent at an approximately ninety degree angle with respect to each of the two legs of each electrical pin.

An integral aspect of this embodiment of the apparatus 10 of the invention is the electrical flat pins 18 and 28 and round ground pin 19, which are bent at approximately a ninety degree angle with respect to the backplate component 14 and fastened to the backplate component 14, as shown in FIG. 5. In this aspect, the height of the horizontal portion of each electrical flat pin 18 and 28 and the round ground pin 19 is approximately less or the same height (or thickness) as the electrical cord 16, which is attached to the electrical flat pins 18 and 28 and to round ground pin 19. Electrical cord 16 is also optionally attached to the backplate component 14. A benefit of the electrical flat pins 18 and 28 and the round ground pin 19 being bent at an approximately ninety degree angle is that the depth of the cover 15, measured by the distance between the wall 23 when the cover 15 is inserted in the underlying electrical wall outlet 11 and the front face of the cover or the outer or exterior surface of the frontplate component 12, resting on top of the backplate 14 which in turn is resting on top of the underlying electrical wall outlet 11, is less than the depth of a typical electrical plug connected in a traditional manner to the electrical wall outlet 11, which is a typical electrical wall outlet, and cover 15 may have less depth than the depth of baseboard molding 21 at the base of the wall 23. For example, a typical electrical plug is at least about an inch wide and when on an electrical cord and inserted into an electrical wall outlet, such as electrical wall outlet 11, such plug and adjacent cord typically protrude or extend outwardly from the outlet a distance of more than an inch and often protrude as much as about two inches to even four inches. In contrast, the cover 15 of the apparatus 10 of the invention when attached to the electrical wall outlet 11 extends outward from the outlet no more than the thickness of the cover 15. Cover 15 is as thin as the thickness of the combination of the frontplate component 12 mounted on the backplate component 14 and the electrical flat pins 18 and 28, the round ground pin 19, and electrical cord 16 in between the components 12 and 14. This combined thickness, or thinness, is less than about an inch and also is less than the thickness of a typical baseboard at the base of a wall in preferred embodiments.

Figure 6:
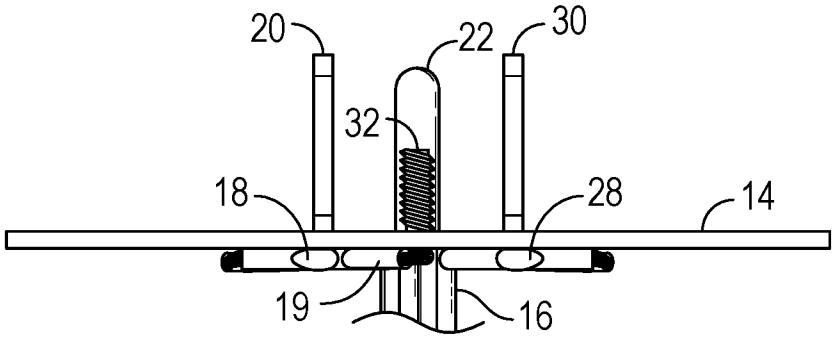
FIG. 6 is a top view of the back plate of the embodiment of the apparatus of FIG. 1 showing the electrical flat pins and the round ground pin as they extend out of the back plate.

As shown in FIG. 6, electrical flat pin 18 is associated with plug prong 20 (neutral), electrical pin 28 (hot) is associated with plug prong 30, and round ground pin 19 is associated with ground plug prong 22 (ground). These plug prongs 20, 30 and 22 are like typical electrical plug prongs used in typical wall outlets. In an alternative embodiment, the electrical pins through their respective plug pins shown in FIG. 6 are configured in a plug type that is compatible with a typical non-U.S. indoor electrical wall outlet and the opposite or distal end of the electrical cord 16 has or comprises one or more electrical receptacles or sockets 26 for receiving one or more third-party electrical plugs compatible with a typical non-U.S. indoor electrical wall outlet (not shown).

The conductive electrical flat pins 18 and 28 and round ground pin 19 and corresponding plug prongs 20, 30 and 22 comprise a configuration of one of about fifteen electrical plug types currently in use, as categorized by the U.S. Department of Commerce International Trade Administration. An integral aspect of this embodiment is connection of the electrical flat pins 18 and 28, through respective plug prongs 20 and 30, to the respective contacts 31 and 33 in a receptacle of wall outlet 11 as shown in FIG. 2 of the underlying interior electrical wall outlet 11 without any visible electrical flat pins 18 or 28 or visible round ground pin 19, which are all fully concealed under the backplate component 14 and the frontplate component 12 mounted to the backplate component 14. Electrical flat pins 18 and 28 and round ground pin 19 comprise the proximal end of electrical cord 16 of the apparatus 10 of the invention. The opposite or distal end of the electrical cord 16 as shown for example in FIG. 1 has or comprises one or more electrical receptacles or sockets 26 for receiving in one embodiment one or more third-party electrical plugs compatible with a typical indoor electrical wall outlet for utility, namely electricity consumption. Such third-party electrical plugs are not part of the invention, but rather are associated with various household and personal devices that require electricity for operation or for battery charging for operation. In an alternative embodiment, such electrical receptacles or sockets 26 at the distal end of the electrical cord 16 are comprised to receive one or more plugs for charging electronic devices such as cell phones and tablets.

The distal end of electrical cord 16 can be any shape and have any receptacle or socket configuration that is useful for containing or providing electrical receptacles, such as for nonlimiting example a power strip 29 as shown in FIG. 1 or an electrical receptacle power hub (not shown) or an electrical receptacle power cube (not shown), but in most embodiments will be configured to have more than one receptacle 26. In one embodiment, such receptacles or sockets in the distal end of electrical cord 16 are all standard receptacles. In another embodiment, such receptacles or sockets in the distal end of electrical cord 16 comprise at least one interchangeable plug for use in North America, South America, Europe, Asia, or Australia. In still another embodiment, such receptacles in the distal end of electrical cord 16 also include or comprise one or more USB ports. In another alternative embodiment, electrical cord 16 simply ends in a single receptacle plug. In still another alternative embodiment, electrical cord 16 ends in a power strip 29 comprising a retracting mechanism (not shown) so that cord 16 can be pulled to the exact length needed or desired between the wall outlet 11 and the receptacle(s) 26 at the distal end of electrical cord 16 for utility. Such retracting mechanism would include a catch and release mechanism to hold the cord at the desired length, and to hold the cord tightly at that length so the cord appears neat and unobtrusive along the wall and floor or any other surface it is directed to extend or lay.

The exact desired length of electrical cord 16 will vary depending on the intended use of the invention. Generally, the length is sufficient for electrical cord 16 to extend from backplate 14 or cover 15 and be manually guided around any adjacent or nearby furniture and positioned so that the distal end of the electrical cord 16 of apparatus 10 of the invention is conveniently and safely located for use of the receptacle (s) 26 or socket(s) in said distal end of cord 16. In one embodiment, for example, the distance the cord will extend is selected from a range of about three feet to about thirty feet, although many different variations would work, and longer cords could be used. The length of the cord is generally limited by practical reasons—one does not want a cord so long that excess cord gets in the way of furniture and becomes unsightly or a tripping hazard. As stated above, the present invention advantageously enables furniture to be positioned flush against the wall and in front of a wall outlet covered by the cover 15 of the apparatus of the invention.

As indicated above, through use of electrical cord 16, the apparatus of the present invention advantageously eliminates the need to attach an electrical plug of an electrical device directly to the contact openings of a receptacle of an electrical wall outlet for use of the outlet. Further, in this aspect, the present invention has an aesthetic benefit with embodiments whereby multiple functional receptacles or sockets are at the distal end of the electrical cord over conventional attachment of multiple cords directly to the outlet. That is, a single cord of the apparatus of the invention in such embodiments has the same utility or functionality with respect to providing electricity to multiple third party devices as would be typical with multiple cords extending directly from the outlet in traditional or conventional use without the invention.

The apparatus of the invention also advantageously can be used with any standard, conventional, or typical indoor electrical wall outlet in the United States or elsewhere. In this aspect, in one embodiment, as shown in the Figures, at least one screw 32 is positioned through at least one aperture 34 of the apparatus of the invention and attaches to a corresponding aperture 36 of the assembly of a standard, conventional, or typical indoor electrical wall outlet such as for example wall outlet 11 for purposes of attachment to the wall outlet. The apparatus of the invention and particularly the cover 15 of the apparatus 10 of the invention is held in place over the wall outlet 11 by insertion of prongs 20, 30, and 22 in respective contacts 31, 33 and 35 of a receptacle of the wall outlet 11, and by insertion of at least one screw 32 of the apparatus 10 in a corresponding hole 36 in the wall outlet 11 as shown in FIG. 2.

Wall outlet 11, as indicated in FIG. 2, and as stated above, is a standard, conventional, or typical indoor electrical wall outlet in the United States, which is believed to be commonly called a one-gang electrical wall outlet, and which has two receptacles or sockets, an upper and a lower receptacle or socket, in vertical alignment with each other. Thus, in one embodiment not shown, the apparatus of the invention 10 attaches to such a standard wall outlet 11 having two receptacles or sockets as stated above by insertion of plug prongs like plug prongs 30 and 20 of the apparatus of the invention 10 into contacts 33 and 31 of a receptacle of the wall outlet 11 and attachment of one or more screws like screws 32 of the invention 10 into one or more corresponding screw holes 36 in the electrical wall outlet 11. In this embodiment, plug prong 22 is not present and grounding is obtained through screw 32 contacting a ground wire through screw hole 35. Although all of the Figures show use of at least one screw 32 to aid in holding the apparatus of the invention over or on the wall outlet, and at least in some embodiments to aid in providing grounding, in some other embodiments screws are not used.

In another embodiment, the apparatus of the invention could be similarly used with a standard one-gang electrical wall outlet having two receptacles or sockets aligned in a horizontal position. In such case, electrical cord 16 would extend from one side of the cover 15, rather than the base of the cover 15 as shown in FIG. 1, or could be adapted (i.e., moved) to extend from the base of the cover in the horizontal position.

The apparatus of the present invention can also be readily adapted for standard, conventional, or typical multi-gang outlets, such as for nonlimiting example, double or triple wall outlets. Such outlets tend to simply be double, triple, quadruple, or other multiple versions of a single gang outlet and thus respectively have four, six, eight, or other multiple receptacles or sockets typically aligned in pairs. Thus the apparatus of the invention would be expanded to accommodate four, six, eight, or other multiple pairs of electrical plugs for insertion into the corresponding outlet receptacles or sockets and the corresponding screw holes of the multi-gang outlets. For another example, in one such alternative embodiment, the multi-gang electrical outlet is sized to support up to about sixteen receptacles or sockets, normally allowing attachment or insertion into the multi-gang electrical outlet as many as sixteen electrical plugs. In such alternative embodiments of the invention for use in multi-gang outlets (not shown), the backplate component of the cover of the apparatus of the invention is sized to align and position over such standard indoor multi-gang electrical wall outlets. The frontplate component is sized to align and position over and curve slightly around the perimeter edge of the backplate component for a tight fit as described above that preferably requires no adhesive or screws to stay in place.

To add to the aesthetics of the cover 15 of the invention, in one embodiment at least the front or exterior of the frontplate is painted or is covered in wallpaper.

In another embodiment of the apparatus of the invention, having an alternative electrical connection to that discussed above and illustrated in FIG. 5, the electrical pins are fastened to the backplate component and connected to an insulated conductive connector which in turn is connected to a wire forming a part of the electrical cord at the proximal end and one or more outlets at the distal or opposite end of the electrical cord to which one or more third-party electrical plugs are connected for electricity consumption.

While the invention has been described with one electrical connection in a cover for a typical indoor electrical wall outlet with two sockets and one electrical cord extending from the cover, the invention can be adapted to having two electrical connections in a cover for insertion into both sockets of a typical indoor electrical wall outlet with two sockets, and a double electrical cord or two electrical cords extending from the cover.

As stated above, the present invention has been illustrated with electrical plugs and receptacles having shapes that are commonly used in the United States of America. However, it is known that different shaped electrical plug prongs and receptacles are used in different countries and the present invention may readily be adapted for those different electrical plug configurations and shapes. In some countries, indoor electrical wall outlets may commonly have one socket rather than two, and the present invention is readily adaptable for such outlets.

While preferred embodiments of the present disclosure have been described, it should be understood that other various changes, adaptations and modifications can be made therein without departing from the spirit of the invention(s) and the scope of the appended claims. The scope of the present disclosure should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed is:

1. An apparatus for hiding a standard indoor electrical wall outlet having at least two receptacles and at least one hole for receiving a screw, while affording continued use of said outlet, the apparatus comprising:

a. a cover comprising:
   (i) a frontplate; and
   (ii) a backplate comprising at least one set of electrical prongs including a hot prong, a neutral prong, and optionally a ground prong, positioned to correspond to at least a first receptacle of the wall outlet;

b. an electrical cord extending from the backplate, or the cover, said cord comprising at the cord's proximal end: at least one hot pin, at least one neutral pin and optionally a ground pin positioned on or fastened or attached to the backplate of the cover in such manner as to minimize distance between the front plate and the backplate, and respectively connected to or associated with the hot prong, neutral prong and any ground prong on the exterior of the backplate, wherein the hot pin and the neutral pin are positioned at approximately right angles to the backplate; and comprising at the cord's distal end at least one receptacle; and c. at least one aperture in each of the backplate and frontplate each with a diameter sufficient to insert a screw and each positioned to correspond to a hole in the wall outlet.

2. The apparatus of claim 1 wherein a ground pin is provided and positioned at approximately right angles to the backplate.

3. The apparatus of claim 1 wherein the height of the hot pin, neutral pin, and any ground pin is approximately the same or less than the thickness of the cord.

4. The apparatus of claim 1 wherein the backplate fits inside the frontplate and the backplate and the frontplate hold together without fasteners, attachers, or adhesive.

5. The apparatus of claim 1 wherein the frontplate has perimeter edges and the backplate has outer edges and the perimeter edges of the frontplate curve over the outer edges of the backplate.

6. The apparatus of claim 1 wherein the cover has a shape mimicking the wall outlet but sufficiently larger to completely cover the wall outlet when attached to the wall outlet by insertion of the set of electrical prongs into the first receptacle of the wall outlet and by insertion of at least one screw through the apertures in the frontplate and the backplate into a corresponding hole of the wall outlet.

7. The apparatus of claim 1 wherein the cover is attached to the wall outlet by insertion of the set of electrical prongs into the first receptacle of the wall outlet and by insertion of at least one screw through the apertures in the frontplate and the backplate into a corresponding hole of the wall outlet, and the cover when so attached does not extend outwardly from the wall outlet more than about an inch.

8. The apparatus cover of claim 1 wherein the exterior surface of the frontplate is substantially blank.

9. The apparatus of claim 1 comprising a first set of electrical prongs including a hot prong, a neutral prong, and optionally a ground prong, positioned to correspond to a first receptacle of the wall outlet and a second set of electrical prongs including a hot prong, a neutral prong, and optionally a ground prong, positioned to correspond to a second receptacle of the wall outlet.

10. The apparatus of claim 1 comprising a first set of electrical prongs including a hot prong, a neutral prong, and optionally a ground prong, positioned to correspond to a first receptacle of the wall outlet and at least one non-conductive prong positioned to correspond to the second receptacle of the wall outlet, wherein the second receptacle has a ground contact for receiving at least one non-conductive prong.

11. The apparatus of claim 1 wherein at least one side of the frontplate or backplate has, or one side of the frontplate and backplate together have, or form, a hole or slot from which the cord extends.

12. The apparatus of claim 1 wherein the cord further comprises at the cord's distal end at least one USB port.

13. The apparatus of claim 1 wherein the cord is retractable at the cord's distal end.

14. The apparatus of claim 1 wherein the distance that the cord extends from the cover is an amount selected from the range of about three feet to about thirty feet.

15. The apparatus of claim 1 wherein the cover is sized to hide an electrical wall outlet having four to sixteen receptacles.

16. The apparatus of claim 15 wherein the backplate comprises at least one set of electrical prongs including a hot prong, a neutral prong, and optionally a ground prong, positioned to correspond to at least one of the receptacles of the wall outlet.

17. An apparatus for hiding a standard indoor electrical wall outlet having at least one receptacle while affording continued use of said outlet, the apparatus comprising:

a. a cover comprising:

(i) a front portion, or a frontplate with perimeter edges, and (ii) a back portion, or a backplate with outer edges comprising at least one set of electrical prongs including a hot prong, a neutral prong, and optionally a ground prong, positioned to correspond to one receptacle of the wall outlet, wherein either: the perimeter edges of the frontplate curve over the outer edges of the backplate, the backplate fits inside the frontplate, and the backplate and the frontplate hold together without fasteners, attachers, or adhesive; or the front portion and the back portion are formed together to comprise one piece; and b. an electrical cord extending from the backplate, or the cover, said cord comprising:

(i) at the cord's proximal end: at least one hot pin, at least one neutral pin and optionally a ground pin, positioned at approximately right angles on the back portion or backplate of the cover in such manner as to minimize the distance between the front plate and the back portion or backplate so that said distance does not exceed the thickness of the cord, and said hot pin, neutral pin and any ground pin are respectively connected to or associated with the hot prong, neutral prong and any ground prong on the exterior of the back portion or backplate; and (ii) at the cord's distal end: at least one receptacle.

18. The apparatus of claim 17 wherein the cover has a shape mimicking the wall outlet but sufficiently larger to completely cover the wall outlet when held on or over the wall outlet by insertion of the set of electrical prongs into the receptacle of the wall outlet; and wherein when so held the cover does not extend outwardly from the wall outlet more than about one inch.

19. The apparatus of claim 17 wherein the wall outlet has at least one hole for receiving a screw and wherein the cover has at least one aperture therethrough with a diameter sufficient to insert a screw and positioned to correspond to the at least one hole in the wall outlet.

20. The apparatus of claim 19 wherein the wall outlet has three holes for receiving a screw and wherein the cover has three apertures therethrough with a diameter sufficient to insert a screw and respectively positioned to correspond to the three holes in the wall outlet.

* * * * *